US008085229B2

(12) United States Patent
Lee et al.

(10) Patent No.: US 8,085,229 B2
(45) Date of Patent: Dec. 27, 2011

(54) OPTICALLY COMPENSATED BEND (OCB) LIQUID CRYSTAL DISPLAY AND METHOD OF OPERATING SAME

(75) Inventors: Jun-Woo Lee, Anyang-si (KR); Chang-Hun Lee, Yongin-si (KR); Eun-Hee Han, Seoul (KR); Hee-Seop Kim, Hwasung-si (KR); Lujian Gang, Yongin-si (KR)

(73) Assignee: Samsung Elctronics Co., Ltd., Suwon-Si (KR)

( * ) Notice: Subject to any disclaimer, the term of this patent is extended or adjusted under 35 U.S.C. 154(b) by 1233 days.

(21) Appl. No.: 11/482,085

(22) Filed: Jul. 6, 2006

(65) Prior Publication Data

US 2007/0030227 A1 Feb. 8, 2007

(30) Foreign Application Priority Data

Aug. 5, 2005 (KR) ..... 10-2005-0071783

(51) Int. Cl.
*G09G 3/36* (2006.01)

(52) U.S. Cl. ..... 345/87; 345/107

(58) Field of Classification Search ..... 345/204, 345/690–693, 87–100
See application file for complete search history.

(56) References Cited

U.S. PATENT DOCUMENTS

| | | | | |
|---|---|---|---|---|
| 7,106,350 | B2 * | 9/2006 | Baba et al. | 345/691 |
| 7,193,594 | B1 * | 3/2007 | Yamazaki et al. | 345/89 |
| 7,773,066 | B2 * | 8/2010 | Yamazaki et al. | 345/89 |
| 2002/0109654 | A1 | 8/2002 | Kwon | 345/87 |
| 2002/0196220 | A1 * | 12/2002 | Sato et al. | 345/87 |
| 2005/0088398 | A1 * | 4/2005 | Lee | 345/100 |
| 2005/0157559 | A1 | 7/2005 | Lee et al. | |
| 2007/0200809 | A1 * | 8/2007 | Yamazaki et al. | 345/89 |
| 2010/0103158 | A1 * | 4/2010 | Lee | 345/211 |

FOREIGN PATENT DOCUMENTS

| | | |
|---|---|---|
| CN | 1457449 | 11/2003 |
| JP | 09-325322 | 12/1997 |
| JP | 2001-042282 | 2/2001 |
| JP | 2002-041002 | 2/2002 |
| JP | 2003-172915 | 6/2003 |
| JP | 2003-186456 | 7/2003 |
| JP | 2003-295156 | 10/2003 |
| JP | 2004-212938 | 7/2004 |
| JP | 2004-253827 | 9/2004 |
| JP | 2005-181559 | 7/2005 |

(Continued)

*Primary Examiner* — Nitin Patel
(74) *Attorney, Agent, or Firm* — F. Chau & Associates, LLC

(57) ABSTRACT

In a optically compensated bend (OCB) liquid crystal display, an impulsive voltage is applied to a pixel between applications of normal data voltages for displaying an image, and the impulsive voltage and the normal data voltage are controlled to prevent breaking of the bending alignment of the (OCB) liquid crystals. Accordingly, luminance of the liquid crystal display can be improved.

When the normal data voltage of 0V is applied, the impulsive voltage at which the bending alignment of OCB liquid crystal is broken is set to the impulsive voltage at (for, corresponding to) the highest gray. There occurs a broken region (0-$V_B$) where the bending alignment of the OCB liquid crystal is broken at a predetermined range that is higher than 0V. A voltage that is higher than the highest voltage ($V_B$) of the broken region is set to a white voltage. Accordingly, luminance of the OCB liquid crystal display can be enhanced.

20 Claims, 5 Drawing Sheets

FOREIGN PATENT DOCUMENTS

| | | | |
|---|---|---|---|
| KR | 1020020080248 | | 10/2002 |
| KR | 10-2004-0004858 | | 1/2003 |
| KR | 10-0401377 | | 9/2003 |
| KR | 10-2004-0000409 | | 1/2004 |
| KR | 10-2004-0061343 | | 7/2004 |
| KR | 10-2005-0001723 | | 1/2005 |
| KR | 10-2005-0001781 | | 1/2005 |
| KR | 10-2005-0062855 | * | 6/2005 |

* cited by examiner

OPTICALLY COMPENSATED BEND (OCB) LIQUID CRYSTAL DISPLAY AND METHOD OF OPERATING SAME

CROSS-REFERENCE TO RELATED APPLICATION

This application claims priority, under 35 U.S.C. §119, of Korean Patent Application No. 10-2005-0071783 filed in the Korean Intellectual Property Office on Aug. 05, 2005, the entire contents of which are incorporated herein by reference.

BACKGROUND OF THE INVENTION

1. Field of the Invention

The present invention relates to a liquid crystal display, and more particularly, to an optically compensated bend (OCB) liquid crystal display controlled to prevent breaking of the bending alignment of the OCB liquid crystals.

2. Description of the Related Art

A liquid crystal display is one of the most widely used among types of flat panel displays. The liquid crystal display includes two sheets of display panels in which field generating electrodes, such as pixel electrodes and common electrodes, are formed, and a liquid crystal layer interposed between the display panels. The liquid crystal display applies a voltage to the field generating electrode in order to generate an electric field in the liquid crystal layer, determines the direction of liquid crystal molecules of the liquid crystal layer based on the electric field, and displays an image by controlling the polarization of incident light.

A variety of methods have been proposed in order to improve the response speed and reference viewing angle of LCD displays. For example, there are liquid crystal displays using an optically compensated bend (OCB) method. An OCB mode LCD includes an alignment layer formed on each substrate, and the alignment layers provide a force to align the liquid crystal molecules in a direction substantially parallel to the two substrates. Also, since the liquid crystal molecules move in the same orientation when the LCD is operated, a wide viewing angle and a fast response time are realized.

In the liquid crystal display employing the OCB method, when an electric field is applied between the two field generating electrodes, orientations of liquid crystal molecules become variously oriented from a horizontal arrangement to a vertical arrangement until they reach from the substrate surface to the central surface (the arrangement of liquid crystal molecules being symmetrical to the central plane between two substrates). Therefore, a wide reference viewing angle can be obtained. To obtain such a bent alignment of the liquid crystal molecules, a horizontal alignment agent that is oriented in the same direction is used and a high voltage is initially applied. To obtain the varying alignment of the liquid crystal molecules, the alignment layer on each of the two substrates undergoes an alignment process such as rubbing in one direction. Then a high voltage is applied so as to produce a bending alignment.

If the voltage falls below a predetermined value, however, the bending alignment of the liquid crystal layer may be broken.

The above information disclosed in this Background section is only for enhancement of understanding of the background of the invention and therefore it may contain information that does not form the prior art that is already known in this country to a person of ordinary skill in the art.

SUMMARY OF THE INVENTION

An aspect of the present invention provides an OCB liquid crystal display that can stably operate without breaking the bending alignment of the optically compensated bend (OCB) liquid crystal.

Another aspect of the present invention provides a liquid crystal display with improved luminance.

In accordance with an exemplary embodiment of the present invention, an impulsive voltage is applied between normal data voltages that display an image in order to control the impulsive voltage and the normal data voltage at the highest gray. Therefore, the luminance of the liquid crystal display can be enhanced.

In more detail, a liquid crystal display according to an exemplary embodiment of the present invention includes first and second electrodes disposed opposite to each other, and a liquid crystal layer interposed between the first and second electrodes. A normal data voltage representing luminance corresponding to external image information and an impulsive voltage representing luminance that is lower than the luminance of the normal data voltage are alternately applied to the first electrode. Furthermore, an impulsive voltage at the highest gray is set to a (threshold) voltage at which the bending alignment is broken. A voltage higher than the highest voltage of a broken region where the bending alignment is broken is set to the normal data voltage at the highest gray.

The impulsive voltage at the highest gray may have a value lower than 2.4 V.

The impulsive voltage may have a voltage representing black at a predetermined gray or less, and it may have a value that can represent a monotonically increasing luminance at a gray higher than the predetermined gray.

The liquid crystal display may be normally white.

Assuming that a time ratio in which the normal data voltage and the impulsive voltage are maintained is a duty ratio, the duty ratio may be in the range of 1:1 to 4:1.

As the time interval where the impulsive voltage is maintained is lengthened, the impulsive voltage at the highest gray may be lowered.

The impulsive voltage at the highest gray may be 2.0V and the normal data voltage at the highest gray may be 0.9V.

The present invention will be further described in connection with specific embodiments with reference to the accompanying drawings in order for those skilled in the art to be able to understand, make and use the invention. As those skilled in the art would realize, the described exemplary embodiments may be modified in various ways, all without departing from the spirit or scope of the present invention as defined in the claims.

When it is said that any part, such as a layer, film, area, or plate is positioned on another part, it means the part is directly on the other part or above the other part with at least one intermediate part. On the other hand, if any part is said to be positioned directly on another part it means that there is no intermediate part between the two parts.

BRIEF DESCRIPTION OF THE DRAWINGS

In the drawings, to clarify multiple layers and regions, the thicknesses of the layers are enlarged. Like reference numerals designate like elements throughout the specification. In the drawings.

DETAILED DESCRIPTION OF THE EXEMPLARY EMBODIMENTS

Figure 1:
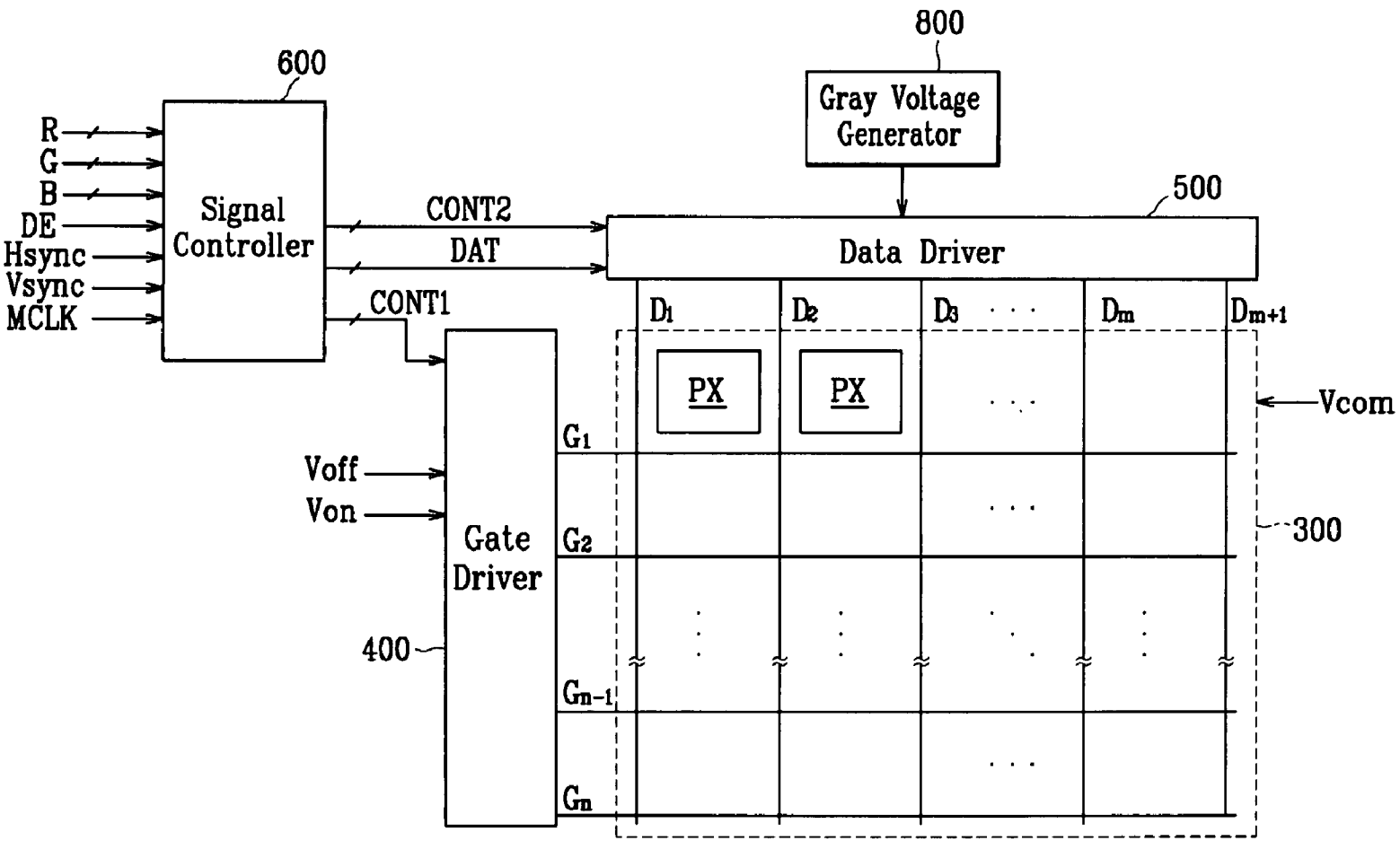
FIG. 1 is a block diagram of a liquid crystal display according to an exemplary embodiment of the present invention.
Figure 2:
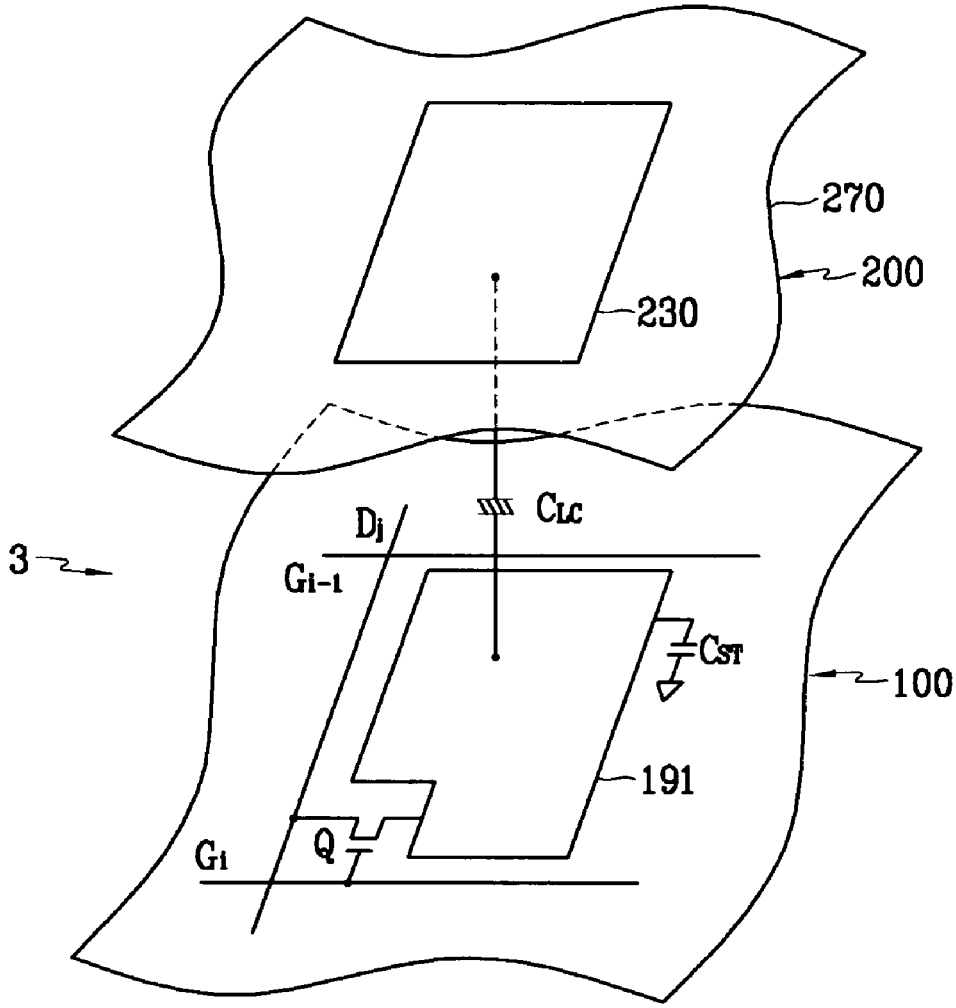
FIG. 2 is an equivalent circuit diagram of one pixel of the liquid crystal display of FIG. 1.

FIG. 1 is a block diagram of a liquid crystal display according to an exemplary embodiment of the present invention. FIG. 2 is an equivalent circuit diagram of one pixel of the liquid crystal display of FIG. 1.

As shown in FIG. 1, the liquid crystal display according to an exemplary embodiment of the present invention includes a liquid crystal panel assembly 300, a gate driver 400 and a data driver 500 that are connected to the liquid crystal panel assembly 300, a gray voltage generator 800 connected to the data driver 500, and a signal controller 600 for controlling the above-mentioned elements.

The liquid crystal panel assembly (LCD pixel array) 300 includes a plurality of display signal lines (gate lines $G_1$-$G_n$, and data lines $D_1$-$D_m$), and a plurality (n×m) of pixels (PX) that are connected to the signal lines and are approximately arranged in a matrix form. As shown in FIG. 2, the liquid crystal panel assembly 300 includes lower and upper panels 100 and 200 that are opposite to each other, and a liquid crystal layer 3 interposed between the lower and upper panels 100 and 200. The liquid crystal layer 3 includes optically compensated bend (OCB) liquid crystals 31 having a bending alignment.

Figure 3:
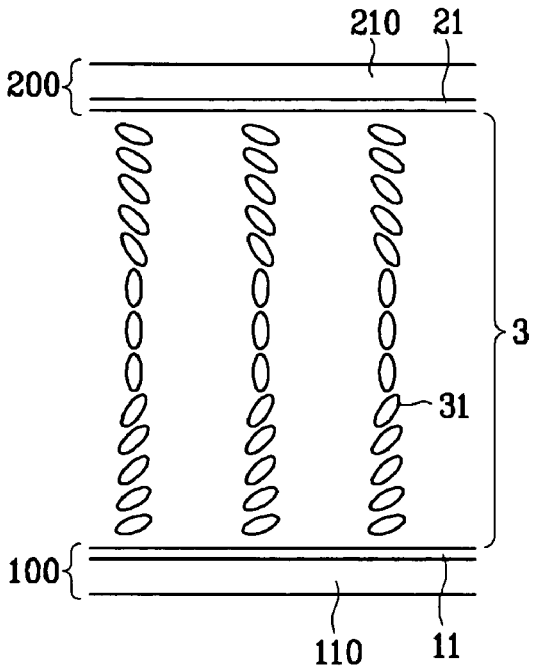
FIG. 3 is a cross-sectional view of one pixel of the liquid crystal display of FIG. 1, and illustrates a bent alignment state of liquid crystal molecules.

FIG. 3 is a cross-sectional view of one pixel of the liquid crystal display of FIG. 1, and illustrates a bent alignment state of liquid crystal molecules 31.

The liquid crystal layer 3 includes nematic liquid crystal with positive dielectric anisotropy. The liquid crystal layer 3 is aligned according to the OCB method, and has a bending alignment as shown in FIG. 3. In general, the OCB mode liquid crystal display displays "normally white", i.e., white when there is no applied voltage (no electric field applied across the LCD layer). In the OCB mode LCD, a symmetrical arrangement is realized about an imaginary center plane between the two substrates and parallel to the same. Thus, the liquid crystal molecules are aligned substantially parallel to the substrates, then are increasingly slanted (bent) until reaching this center plane where the liquid crystal molecules 31 are substantially perpendicular to the two substrates. Thus, LCD molecules 31 are symmetrical to each other about the central surface of the lower and upper panels 100 and 200, as shown in FIG. 3.

Referring to FIG. 2, the signal lines ($G_1$-$G_n$, $D_1$-$D_m$) include a plurality of gate lines ($G_1$-$G_n$) that transfer a gate signal (also referred to as a "scanning signal"), and a plurality of data lines ($D_1$-$D_m$) that transfer a image data signals. The gate lines ($G_1$-$G_n$) extend approximately in a row (horizontal) direction and are generally parallel to each other. The data lines ($D_1$-$D_m$) extend approximately in a column (vertical) direction and are generally parallel to each other.

Each pixel (PX) (e.g., a pixel PXij connected to an i-th (i=1, 2, . . . , n) gate lines (Gi) and a j-th (j=1, 2, . . . , m) data line (Dj)) includes a switching element Q connected to the respective signal lines (Gi, Dj), and a liquid crystal capacitor ($C_{LC}$) and a storage capacitor ($C_{ST}$) that are connected to the switching element Q. The storage capacitor ($C_{ST}$) may be omitted, if appropriate.

The switching element Q is a three-terminal thin film transistor, etc., which is formed in the lower panel 100. The switching element Q has a control terminal connected to the gate lines ($G_1$-$G_n$), an input terminal connected to the data lines ($D_1$-$D_m$), and an output terminal connected to the liquid crystal capacitor ($C_{LC}$) and the storage capacitor ($C_{ST}$).

The liquid crystal capacitor ($C_{LC}$) uses a pixel electrode 191 of the lower panel 100 and a common electrode 270 of the upper panel 200 as it's two terminals. The liquid crystal layer 3 between the two electrodes 191 and 270 functions as a dielectric material of the liquid crystal capacitor ($C_{LC}$). The pixel electrode 191 is connected to the switching element Q. The common electrode 270 is formed on the entire surface of the upper panel 200 and is supplied with a common voltage Vcom. Alternatively, unlike as shown in FIG. 2, the common electrode 270 may be disposed in the lower panel 100. At least one of the two electrodes 191 and 270 may have a linear or bar shape.

In the storage capacitor ($C_{ST}$) that serves to assist the liquid crystal capacitor ($C_{LC}$), a separate signal line (not shown) provided in the lower panel 100 and the pixel electrode 191 are overlapped with an insulator therebetween. The separate signal line is supplied with a predetermined voltage such as the common voltage Vcom. In the storage capacitor ($C_{ST}$), however, the pixel electrode 191 may be overlapped with an immediately upper front gate line through the medium of the insulator.

Meanwhile, to implement color display, each pixel (PX) may uniquely display one of the primary colors (spatial division) or each pixel (PX) may display the primary colors alternately depending on time (temporal) division, so that a desired color is recognized through a spatial and temporal sum of the primary colors red, green, blue. FIG. 2 shows an example of spatial division, wherein each pixel (PX) includes a color filter 230 that represents one of the primary colors on the region of the upper panel 200 corresponding to the pixel electrode 191. Alternatively, unlike as shown in FIG. 2, the color filter 230 may be formed on or below the pixel electrode 191 of the lower panel 100.

The liquid crystal display may also include a backlight unit (not shown) that supplies light to the display panels 100 and 200 and the liquid crystal layer 3.

Two polarizers (not shown) are provided on outer surfaces of the display panels 100 and 200. Transmissive axes of the two polarizers may be orthogonal to each other.

A compensation film may be adhered between the polarizers and the display panels 100 and 200. A C plate compensation film, a biaxial compensation film, or the like may be used as the compensation film.

Referring back to FIG. 1, the gray voltage generator 800 generates generating gray voltages, and more particularly, generates two sets of gray voltage voltages related to the transmittance of the pixel (PX). The two gray voltage sets are generated based on two different gamma curves. This will be described below in more detail with reference to FIG. 6.

The gate driver 400 is connected to the gate lines ($G_1$-$G_n$) of the liquid crystal panel assembly 300 and applies the gate signal, which consists of a gate-on voltage Von and a gate-off voltage Voff, to the gate lines ($G_1$-$G_n$).

The data driver 500 is connected to the data lines ($D_1$-$D_m$) of the liquid crystal panel assembly 300. The data driver 500 selects a gray voltage for each data line from the gray voltage generator 800 and applies the selected gray voltages to the data lines ($D_1$-$D_m$) as the data signal. However, in the case where the gray voltage generator 800 does not supply voltages for all grays, but applies only a predetermined number of reference gray voltages, the data driver 500 divides the reference gray voltages to generate gray voltages for all grays and selects the data signal from the generated gray voltages.

The signal controller 600 controls the gate driver 400, the data driver 500, and so on.

Each of the driving apparatuses 400, 500, 600, and 800 may be integrated on and mounted in the liquid crystal panel assembly 300 as at least one IC chip, may be mounted on a flexible printed circuit film (not shown) and then be adhered to the liquid crystal panel assembly 300 in a tape carrier package (TCP) form, or may be mounted in a printed circuit board (PCB) (not shown). Alternatively, the driving apparatuses 400, 500, 600, and 800 may be integrated with the liquid crystal panel assembly 300 along with the signal lines ($G_1$-$G_n$, $D_1$-$D_m$), the thin film transistor switching element Q, and/or the like. In addition, the driving apparatuses 400, 500, 600, and 800 may be integrated into a single chip. In this case, at least one of the driving apparatuses 400, 500, 600, and 800 or at least one circuit device forming them may be disposed outside the single chip.

The operation of the liquid crystal display of FIG. 1 above will now be described below in a more detailed manner with reference to FIG. 4.

Figure 4:
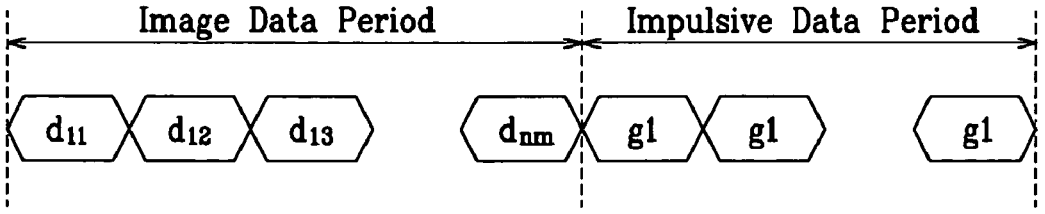
FIG. 4 is a timing diagram illustrating a data signal and an impulse signal in the liquid crystal display of FIG. 1.

FIG. 4 is a timing diagram illustrating a data signal and an impulse signal in the liquid crystal display of FIG. 1.

The signal controller 600 (FIG. 1)_receives input image signals R, G, and B, and an input control signal to control the display of the image signals R, G, and B from a graphics controller (not shown). The input image signals R, G, and B contain luminance information for each pixel (PX). The luminance has a predetermined number of grays, such as 1024 ($=2^{10}$), 256 ($=2^8$), or 64 ($=2^6$).

The signal controller 600 processes the input image signals R, G, and B in such a way to be suitable for the operating conditions of the liquid crystal panel assembly 300 and the data driver 500 based on the input image signals R, G, and B and the input control signals. Examples of the input control signals may include a vertical synchronization signal Vsync, a horizontal synchronizing signal Hsync, a main clock signal MCLK, a data enable signal DE, and the like. The signal controller 600 generates a gate control signal CONT1, a data control signal CONT2, and so on, and it sends the gate control signal CONT1 to the gate driver 400 and the data control signal CONT2 and a processed image signal DAT to the data driver 500.

The gate control signal CONT1 includes a scanning start signal (STV) to instruct of the start of (gate) scanning, and at least one clock signal to control an output cycle of the gate-on voltage Von. The gate control signal CONT1 may further include an output enable signal (OE) to define a sustaining time of the gate-on voltage Von.

The data control signal CONT2 includes a horizontal synchronization start signal (STH) informing of the transmission start of image data for a row of pixels (PX), a load signal (LOAD) to instruct the data signal to be applied to the data lines ($D_1$-$D_m$), and a data clock signal (HCLK). The data control signal CONT2 may further include an inversion signal (RVS) to invert the voltage polarity of the data signal for the common voltage Vcom (hereinafter, "the voltage polarity of the data signal for the common voltage" is abbreviated to "the polarity of the data signal").

Referring to FIG. 4, the image signal DAT sent from the signal controller 600 to the data driver 500 includes normal image data ($d_{11}$-$d_{nm}$) and impulsive data (impulse signals) (g1). The impulsive data (g1) may be formed by processing the input image signals R, G, and B according to a predetermined rule.

The data driver 500 receives the normal image data ($d_{11}$-$d_{nm}$) and the impulsive data (g1) and converts each of them into a normal analog data voltage and an impulsive analog data voltage, respectively, according to the data control signal CONT2 from the signal controller 600. The normal analog data voltage is selected from one of the two gray voltage sets from the gray voltage generator 800, that satisfies the curve (i) of FIG. 6. The impulsive analog data voltage is selected from the other one of the two gray voltage sets from the gray voltage generator 800, that satisfies the curve (ii) of FIG. 6.

The data driver 500 sequentially applies the normal data voltage and the impulsive data voltage to corresponding data lines ($D_1$-$D_m$), according to the sequence illustrated in FIG. 4.

The gate driver 400 applies the gate-on voltage Von to the gate lines ($G_1$-$G_n$) according to the gate control signal CONT1 from the signal controller 600, thereby turning ON the switching element Q connected to the gate lines ($G_1$-$G_n$). The data signal applied to the data lines ($D_1$-$D_m$) is thus applied to a corresponding pixel (PX) through the turned-on switching element 0.

A difference between the voltage of the data signal applied to the pixel (PX) and the common voltage Vcom may be represented as a charge voltage of the liquid crystal capacitor ($C_{LC}$), i.e., a pixel voltage. The liquid crystal molecules have a different alignment depending on an amount of the pixel voltage. Accordingly, the polarization of light that passes through the liquid crystal layer 3 is varied depending on an amount of the pixel voltage. The change in the polarization is represented as a change in the transmittance of light by means of the polarizers adhered to the display panel assembly 300.

The above process is repeated each 1 horizontal period (also referred to as "1H", which is the same as one cycle of the horizontal synchronizing signal Hsync and the data enable signal DE). Accordingly, the gate-on voltage Von is sequentially applied to all gate lines ($G_1$-$G_n$) and the data signals are applied to the pixels (PX), thereby displaying an image of one frame.

As illustrated in FIG. 4, the signal controller 600 (FIG. 1) alternately outputs the normal image data ($d_{11}$-$d_{nm}$) and the impulsive data (g1). There are various methods by which the data driver 500 that has received the normal image data ($d_{11}$-$d_{nm}$) and the impulsive data (g1) converts them into a normal data voltage and an impulsive voltage and applies the converted voltage to each pixel (PX). Several examples of such methods will be described as follows.

A first method includes applying the normal data voltage to all pixels once and then applying the impulsive data voltage to all pixels (sequentially).

A second method includes dividing all pixels on a pixel-row basis. In this state, the normal data voltage is applied to some pixel rows and the impulsive data voltage is applied to the remaining pixel rows. The application of the impulsive voltage to the remaining pixel rows may be classified into two methods. One of the methods includes sequentially applying the impulsive voltage to the pixel rows one by one, and the other of the methods includes applying the impulsive voltage to a plurality of pixel rows at the same time.

A third method includes applying the normal data voltage to some of the pixels and applying the impulsive data voltage to the (same) pixels again. The impulsive voltage may be sequentially applied on a pixel-row basis or applied to all pixel rows at once.

A fourth method involves time-division, and includes applying the normal data voltage and the impulsive voltage in the period during which the gate-on signal has been applied to one gate line. Thereafter, the normal data voltage and the impulsive voltage are applied to the remaining gate lines in the same manner. In this case, the ratio between times when the normal data voltage and the impulsive voltage are applied may be changed in various ways.

When one frame is finished, a next frame begins. The state of the inversion signal (RVS) applied to the data driver 500 is controlled so that the polarity of a data signal applied to each pixel (PX) becomes opposite to that applied in a previous frame ("frame inversion"). The polarity of a data signal that flows through one data line may be changed (for example, row inversion, dot inversion), or the polarities of data signals applied to one pixel row may be different (column inversion, dot inversion), depending on a characteristic of the inversion signal (RVS), even within one frame.

Luminance of the liquid crystal display according to an exemplary embodiment of the present invention will be described below in further detail with reference to FIG. 5.

Figure 5:
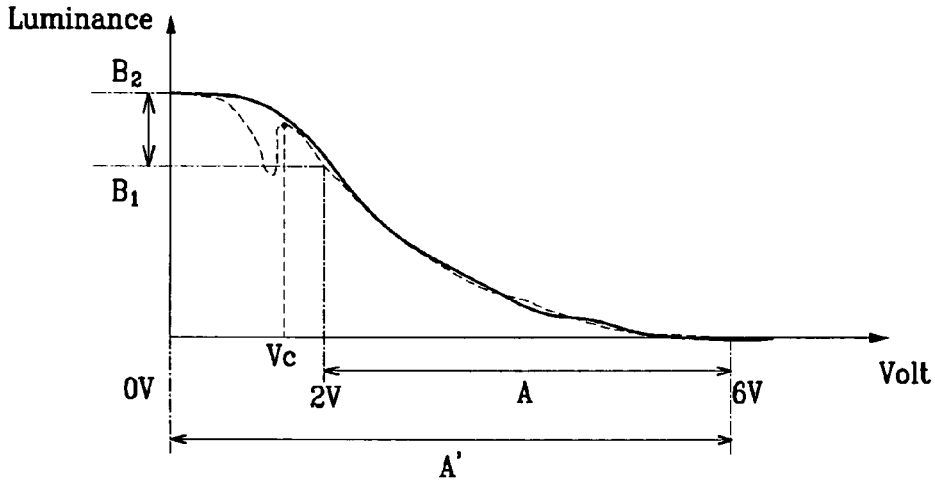
FIG. 5 is a graph showing the comparison result of luminance between when only a normal data voltage is applied in the liquid crystal display of FIG. 1 (a dotted line curve) and when an impulsive voltage is applied between normal data voltages (a solid line curve)

FIG. 5 shows a voltage versus luminance curve when only a normal data voltage is applied (a dotted line curve) and when an impulsive voltage is applied between normal data voltages (a solid line curve). Hereinafter, a case where the impulsive voltage is applied between the normal data voltages will be referred to as "impulsive driving".

In the driving in which only the normal data voltage is applied as indicated by the dotted line curve, there exists an abnormal region (a period in which a voltage value ranges from 0 to Vc) where luminance abruptly decreases as the voltage falls. It is considered that the bending alignment of liquid crystals is broken at a voltage at a point where luminance begins decreasing, i.e., at a normal threshold voltage (Vc) or less.

Accordingly, in the case where only the normal data voltage is applied, the liquid crystal display can be driven only in a voltage range (a period A) over the abnormal region in which luminance shows a stably and monotonically decreasing characteristic depending on voltage, such as only in a voltage range of 2V or higher. Therefore, the highest luminance (B1) that can be displayed by the liquid crystal display is limited.

In the case of the impulse driving as indicated by the solid line curve, however, the abnormal region in which luminance shows a monotonically decreasing characteristic and abruptly falls as a voltage decreases in the entire range does not exist. Accordingly, the voltage range of 0V to 2V can be used as part of the normal data voltage, and luminance that can also be displayed becomes higher than the luminance (B1) (the maximum luminance only when only the normal data voltage is applied). Experiments have shown that the highest luminance (B2) in the impulsive driving mode is about 30% higher than the luminance (B1).

Hereinafter, a voltage and luminance at the highest gray (Gmax) will be described with reference to FIGS. 6 and 7.

Figure 6:
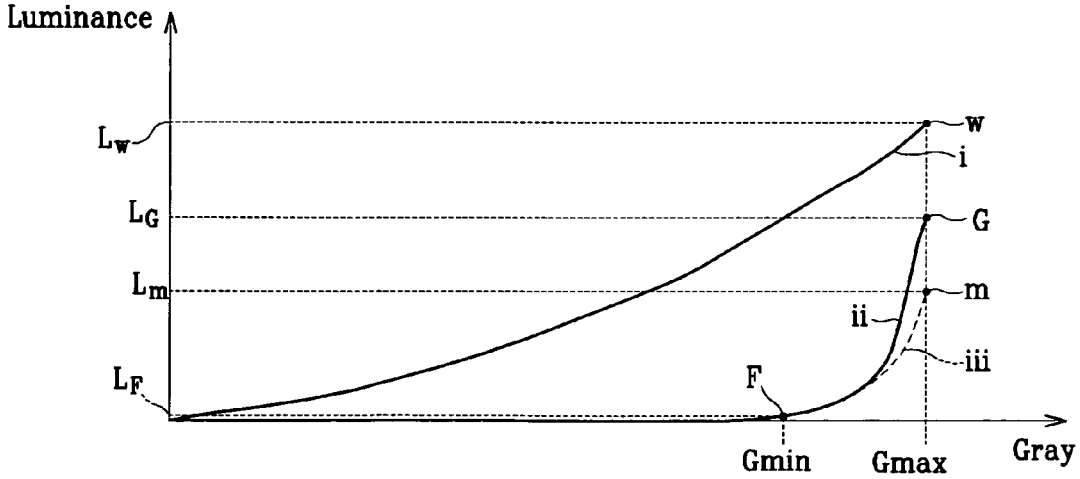
FIG. 6 is a graph showing the gamma curve of the liquid crystal display of FIG. 1 (i) corresponds to a gamma curve for normal data, a curve (ii) corresponds to a gamma curve for impulsive data, and a curve (iii) corresponds to a gamma curve in which an impulsive threshold voltage (Vc') is applied as the impulsive voltage at the highest gray (Gmax)

FIG. 6 is a graph showing a gamma curve of the liquid crystal display according to an exemplary embodiment of the present invention, wherein a curve (i) corresponds to a gamma curve for normal data, a curve (ii) corresponds to a gamma curve for impulsive data, and a curve (iii) is a gamma curve in the case where an impulsive voltage (hereinafter, referred to as an "impulsive threshold voltage (Vc')") at which the bending alignment of OCB liquid crystal begins breaking if the impulsive voltage is lowered when the normal data voltage is 0V is set to an impulsive voltage at the highest gray.

In FIG. 6, the curve (i) is determined according to a characteristic of the liquid crystal display. Curve (ii) shows black with respect to any gray lower than a minimum gray (Gmin) indicated by "F", and shows luminance that monotonically increases with respect to a gray of the minimum gray (Gmin) or higher. At this time, the monotonically increasing luminance may be determined considering the characteristic of the liquid crystal display. Whether to display black or a specific luminance after determining whether a gray is lower or higher than the minimum gray (Gmin) is determined by the signal controller 600. Meanwhile, the curve (iii) is the impulsive voltage of the highest gray (Gmax), and is a gamma curve where the impulsive threshold voltage (Vc') is applied. A dot "m" indicates the location at which the impulsive threshold voltage (Vc') is applied, in FIG. 6. Luminance where the impulsive threshold voltage (Vc') is applied is indicated by "Lm". Furthermore, the curve (ii) shows a luminance ($L_G$) that is higher than the luminance (Lm) when a voltage lower than the impulsive threshold voltage (Vc') is applied as the impulsive voltage of the highest gray (Gmax) and the impulsive threshold voltage (Vc') is applied. If the impulsive voltage is lower than the impulsive threshold voltage (Vc') as in the curve (ii), the bending alignment of the OCB liquid crystal may be broken. To prevent this, a normal data voltage (hereinafter, referred to as a "white voltage") at the highest gray (Gmax) in the curve (i) is raised.

Figure 7:
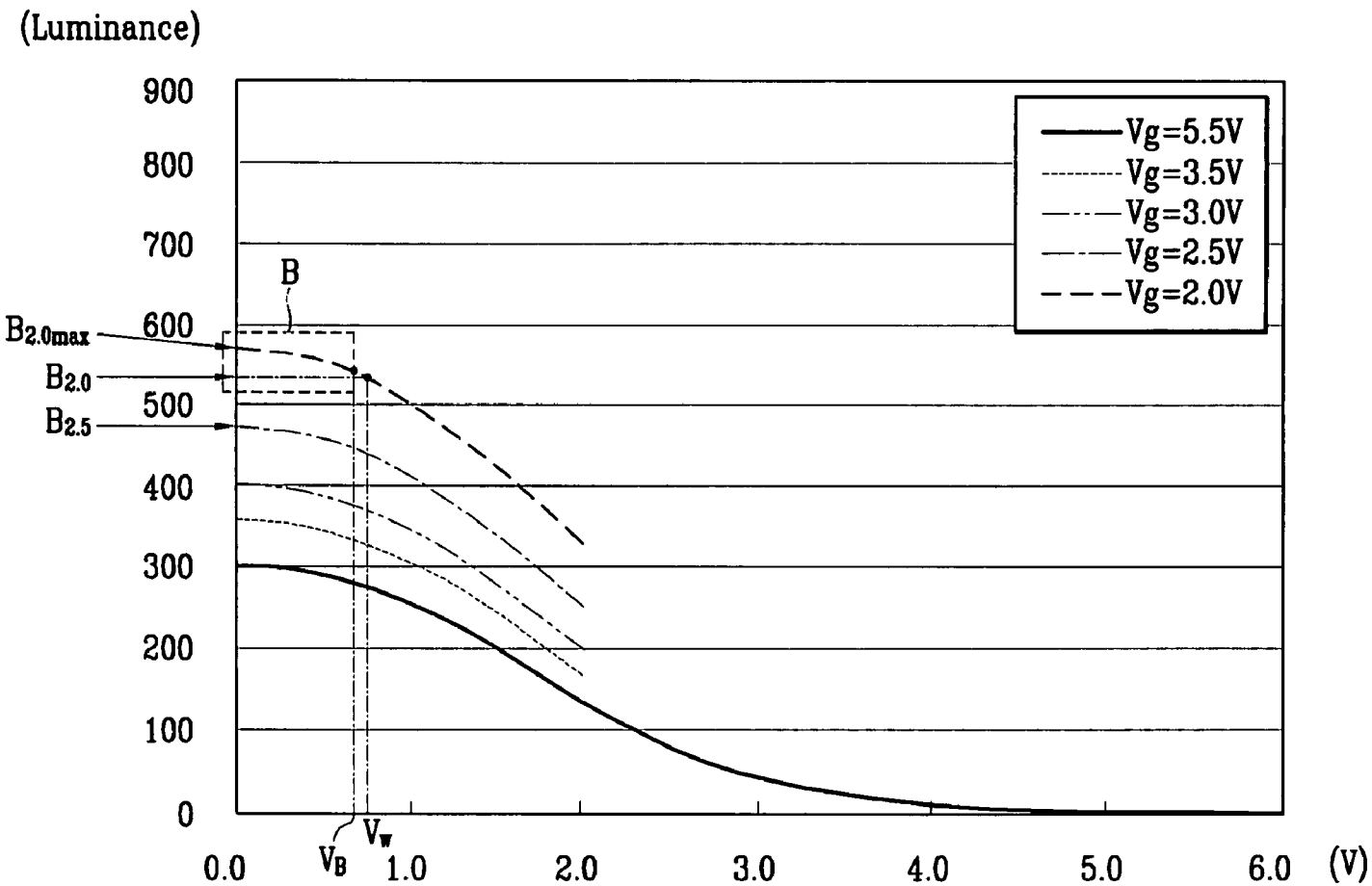
FIG. 7 is a graph showing a voltage versus luminance curve of the liquid crystal display of FIG. 1 depending on the impulsive voltage at the highest gray.

FIG. 7 is a graph showing a voltage versus luminance curve of the liquid crystal display depending on the impulsive voltage at the highest gray.

FIG. 7 shows the relationship of luminance depending on the impulsive voltage and the normal data voltage at the highest gray (Gmax). In the impulsive driving, a time ratio where the normal data voltage and the impulsive voltage are maintained (hereinafter, referred to as a "duty ratio") may be changed in various ways. An experimental result shown in FIG. 7 is determined assuming that the duty ratio is 1:1. The duty ratio may have a value ranging from 1:1 to 4:1.

If the impulsive voltage (Vg) value at the highest gray (Gmax) falls, luminance that can be displayed at the highest gray (Gmax) (0V in FIG. 7), is increased as shown in FIG. 7. If the impulsive voltage (Vg) value at the highest gray (Gmax) is higher than the impulsive threshold voltage (Vc') (up to 2.4V according to the experiment illustrated in FIG. 7), the bending alignment of the OCB liquid crystal is not broken at 0V. However, a problem arises because, at a voltage value lower than the impulsive threshold voltage (Vc'), the bending alignment of the OCB liquid crystal is broken near 0V. A voltage region (0-$V_B$) at which the bending alignment is broken will be hereinafter referred to as a "broken region".

To increase the luminance of the OCB liquid crystal display, an experiment was performed by setting the impulsive voltage (Vg) value at the highest gray to 2.0V. The broken region (B region) occurs as shown in FIG. 7. Luminance did not abruptly fall since the bending alignment was broken at the broken region (B region). Therefore, it was not clearly known from the graph whether the bending alignment was broken. However, as a result of monitoring the liquid crystal alignment, it was confirmed that the bending alignment was broken.

However, the bending alignment of the OCB liquid crystal was not broken at a voltage range higher than the highest voltage ($V_B$) of the broken region (B region). Accordingly, if the normal data voltage is raised at the highest gray (Gmax) (at white voltage, Vw), the OCB liquid crystal display can be driven while not breaking the bending alignment. For example, in the case where the normal data voltage is set to a white voltage as a voltage (Vw) that is higher than the highest voltage ($V_B$) of the broken region (B region), it can be seen that the greatest luminance ($B_{2.0}$) that can be displayed by the OCB liquid crystal display is higher than the greatest luminance ($B_{2.5}$) when the impulsive voltage (Vg) value is set higher than the impulsive threshold voltage (Vc') at the highest gray (Gmax). According to the experiment, the voltage (Vw) of the highest gray (Gmax) may be preferably 0.9V.

In summary, the impulsive voltage (Vg) value is set to a voltage that is lower than the impulsive threshold voltage (Vc') at the highest gray (Gmax). A voltage that is higher than the highest voltage ($V_B$) of the broken region where the bending alignment is broken at a predetermined range of 0V or higher is set to the white voltage. Accordingly, luminance of the OCB liquid crystal display can be improved.

In FIG. 6, the shape of the curve (ii) may be modified depending on a user's intention. A voltage difference between the curve (i) and the curve (ii) may be varied depending on a surface state of a produced panel, liquid crystal and alignment layer material, cell gap, the size of a phase difference film, and the like. However, it is required that the normal data voltage (white voltage) at the highest gray (Gmax) in accordance with the curve (i) of FIG. 6 be higher than or the same as the impulsive voltage at the highest gray (Gmax) in accordance with the curve (ii) of FIG. 6.

Furthermore, in the exemplary embodiment of FIG. 7, the duty ratio was set to 1:1. However, the duty ratio may be varied and the curve (ii) of FIG. 6 may also be changed as the duty ratio is changed. At this time, the duty ratio has a characteristic such that the bending alignment of the OCB liquid crystal is stabilized as the sustain time of impulsive data is lengthened. Accordingly, the impulsive voltage at the highest gray (Gmax) can be further lowered. The luminance of the display device is greatly influenced by the luminance of the curve (i) and the curve (ii) near the highest gray (Gmax) of FIG. 6. If the impulsive voltage at the highest gray (Gmax) is lowered, luminance indicated by the impulsive data at the highest gray (Gmax) is increased. Accordingly, the luminance of the display device itself can be improved.

Table 1 below lists the white voltage (Vw), the impulsive voltage (Vg) at the highest gray and transmittance, which were obtained at the duty ratio of 1:1, 2:1, and 3:1.

TABLE 1

| | Duty ratio | White voltage (Vw) | Impulsive voltage (Vg) at the highest gray | Transmittance |
|---|---|---|---|---|
| Impulsive driving | 1:1 | 0.90 | 2.70 | 4.07 |
| | 2:1 | 0.35 | 3.53 | 4.27 |
| | | 0.50 | 3.50 | 4.26 |
| | | 0.70 | 3.20 | 4.21 |
| | | 0.90 | 2.90 | 4.10 |
| | | 1.10 | 2.70 | 3.00 |
| | 3:1 | 0.35 | 4.14 | 4.55 |
| | | 0.50 | 4.10 | 4.51 |
| | | 0.70 | 3.80 | 4.42 |
| | | 0.90 | 3.40 | 4.21 |
| | | 1.10 | 3.10 | 4.05 |

From Table 1 it can be seen that the smaller the sustain (application) time of the impulsive data due to a higher duty ratio, the higher the impulsive data voltage (Vg) of the highest gray.

Furthermore, in Table 1, a subject liquid crystal is different from that of FIG. 7. Accordingly, when the duty ratio is 1:1, the impulsive data voltage (Vg) of the highest gray is different.

If the duty ratio is constant and the white voltage (Vw) becomes high, the impulsive data voltage (Vg) at the highest gray is lowered and transmittance also decreases.

Table 1 may be set in various ways depending on characteristics of the display device and transmittance of the display device. In alternative embodiments, a voltage and transmittance are set differently depending on characteristics of the liquid crystal and characteristics of the display device.

As described above, when the normal data voltage of 0V is applied, an impulsive voltage at which the bending alignment of OCB liquid crystal is broken is set to an impulsive voltage at the highest gray. At this time, there occurs the broken region where the bending alignment of the OCB liquid crystal is broken at a predetermined voltage range higher than 0V. A voltage higher than the highest voltage ($V_B$) of the broken region is set as the white voltage. Accordingly, luminance of the OCB liquid crystal display can be improved.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A liquid crystal display comprising:

a pixel having first and second electrodes; and an optically compensated bend (OCB) liquid crystal layer interposed between the first and second electrodes and configured to have a bending alignment, a data driver configured to receive external image information and adapted to alternately apply to the first electrode:

a normal data voltage representing a first luminance corresponding to the external image information and an impulsive data voltage representing a second luminance based on the external image information and lower than the first luminance, wherein the impulsive data voltage applied to the first electrode varies between the impulsive data voltage at the highest gray and a predetermined gray voltage, wherein the impulsive data voltage at the highest gray has a value ranging from 2.0V to 3.5V, and wherein the normal data voltage at the highest gray has a value ranging from 0.2V to 0.9V.

2. The liquid crystal display of claim 1, wherein the impulsive data voltage applied to the first electrode is a function of the external image information that monotonically increases luminance at grays higher than the predetermined gray voltage.

3. The liquid crystal display of claim 1, wherein the liquid crystal display is normally white.

4. The liquid crystal display of claim 1, wherein the time ratio between the time intervals that normal data voltage and the impulsive data voltage are maintained is a duty ratio, and the duty ratio is in the range of 1:1 to 4:1.

5. The liquid crystal display of claim 4, wherein the data driver is configured to lower the impulsive data voltage at the highest gray if the time interval that the impulsive data voltage is maintained is lengthened.

6. The liquid crystal display of claim 1, wherein, the impulsive data voltage at the highest gray is about 2.0V and the normal data voltage at the highest gray is about 0.9V.

7. The liquid crystal display of claim 4, wherein, when the duty ratio is 2:1 and the normal data voltage at the highest gray is 0.35V, the impulsive data voltage at the highest gray is 3.53V.

8. The liquid crystal display of claim 4, wherein, when the duty ratio is 2:1 and the normal data voltage at the highest gray is 0.50V, the impulsive data voltage at the highest gray is about 3.50V.

9. The liquid crystal display of claim 4, wherein, when the duty ratio is 2:1 and the normal data voltage at the highest gray is 0.70V, the impulsive data voltage at the highest gray is about 3.20V.

10. The liquid crystal display of claim 4, wherein, when the duty ratio is 2:1 and the normal data voltage at the highest gray is 0.90V, the impulsive data voltage at the highest gray is about 2.90V.

11. The liquid crystal display of claim 4, wherein, when the duty ratio is 3:1 and the normal data voltage at the highest gray is 0.35V, the impulsive data voltage at the highest gray is about 4.14V.

12. The liquid crystal display of claim 4, wherein, when the duty ratio is 3:1 and the normal data voltage at the highest gray is 0.50V, the impulsive data voltage at the highest gray is about 4.10V.

13. The liquid crystal display of claim 4, wherein, when the duty ratio is 3:1 and the normal data voltage at the highest gray is 0.70V, the impulsive data voltage at the highest gray is about 3.80V.

14. The liquid crystal display of claim 4, wherein, when the duty ratio is 3:1 and the normal data voltage at the highest gray is 0.90V, the impulsive data voltage at the highest gray is about 3.40V.

15. The liquid crystal display of claim 4, wherein, when the duty ratio is 1:1 and the normal data voltage at the highest gray is 0.90V, the impulsive data voltage at the highest gray is about 2.70V.

16. A liquid crystal display comprising:

a pixel having first and second electrodes; and an optically compensated bend (OCB) liquid crystal layer interposed between the first and second electrodes and configured to have a bending alignment, a data driver configured to receive external image information and adapted to alternately apply to the first electrode:

a normal data voltage representing luminance corresponding to external image information and an impulsive data voltage representing luminance based on the external image information and lower than the luminance of the normal data voltage , wherein the impulsive data voltage applied to the first electrode varies between the impulsive data voltage at the highest gray and a predetermined gray voltage, wherein the impulsive data voltage at the highest gray has a value ranging from 2.0V to 3.5V, and wherein when the impulsive data voltage of the highest gray is applied, a voltage of the normal data voltage is set to a voltage other than a voltage within the broken region of the gamma curve of the pixel.

17. The liquid crystal display of claim 16, wherein the impulsive data voltage applied to the first electrode is a function of the external image information that monotonically increases luminance at grays higher than the predetermined gray voltage.

18. The liquid crystal display of claim 16, wherein the liquid crystal display is normally white.

19. The liquid crystal display of claim 16, wherein, the ratio between the time interval that the normal data voltage is applied and the time interval that impulsive data voltage is applied is in the range of 1:1 to 4:1.

20. A liquid crystal display comprising:

a pixel having first and second electrodes; and an optically compensated bend (OCB) liquid crystal layer interposed between the first and second electrodes and configured to have a bending alignment, a data driver configured to receive external image information and adapted to alternately apply to the electrode:

a normal data voltage representing luminance corresponding to external image information and an impulsive data voltage representing luminance based on the external image information and lower than the luminance of the normal data voltage, wherein the voltage at which the bending alignment begins breaking when the normal data voltage of 0V is applied is an impulsive threshold voltage, and the impulsive data voltage of the highest gray is set lower than the impulsive threshold voltage, and wherein when the impulsive data voltage of the highest gray is applied, a voltage of the normal data voltage is set to a voltage other than a voltage within the broken region.

* * * * *